US010721562B1

(12) United States Patent
Rui et al.

(10) Patent No.: US 10,721,562 B1
(45) Date of Patent: Jul. 21, 2020

(54) WIND NOISE DETECTION SYSTEMS AND METHODS

(71) Applicant: SYNAPTICS INCORPORATED, San Jose, CA (US)

(72) Inventors: Liyang Rui, Irvine, CA (US); Govind Kannan, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/399,961

(22) Filed: Apr. 30, 2019

(51) Int. Cl.

| | |
|---|---|
| ***H04R 3/00*** | (2006.01) |
| ***G10L 21/02*** | (2013.01) |
| ***G10K 11/16*** | (2006.01) |
| ***H04R 3/04*** | (2006.01) |
| ***G10L 25/06*** | (2013.01) |
| ***G10L 21/0232*** | (2013.01) |
| ***G10L 21/0264*** | (2013.01) |
| ***H04R 5/04*** | (2006.01) |

(52) U.S. Cl.
CPC ..... *H04R 3/04* (2013.01); *G10L 21/0232* (2013.01); *G10L 21/0264* (2013.01); *G10L 25/06* (2013.01); *H04R 3/005* (2013.01); *H04R 5/04* (2013.01)

(58) Field of Classification Search
CPC . H04R 3/00; H04R 3/004; H04R 3/04; H04R 5/00; H04R 5/04; H04R 1/245; H04R 2410/07; G10L 25/06; G10L 21/00; G10L 21/02; G10L 21/0208; G10L 21/0272; G10L 21/232; G10L 21/0264; G10L 2021/02165
See application file for complete search history.

(56) References Cited

U.S. PATENT DOCUMENTS

| | | | | |
|---|---|---|---|---|
| 2004/0008850 | A1* | 1/2004 | Gustavsson | H04R 3/005 381/92 |
| 2004/0161120 | A1* | 8/2004 | Petersen | H04R 3/005 381/92 |
| 2009/0238369 | A1* | 9/2009 | Ramakrishnan | H04R 3/005 381/56 |
| 2012/0123771 | A1* | 5/2012 | Chen | G10L 21/0208 704/226 |
| 2012/0163622 | A1* | 6/2012 | Karthik | H04R 3/005 381/92 |
| 2014/0140524 | A1* | 5/2014 | Petit | G10L 21/0208 381/71.1 |

(Continued)

*Primary Examiner* — Thang V Tran
(74) *Attorney, Agent, or Firm* — Haynes and Boone, LLP

(57) ABSTRACT

Systems and methods include a wind detector to receive audio input signals and output a wind detection flag including a single channel wind detection flag and a cross channel wind detection flag, each wind detection flag indicating a presence or absence of wind noise, and a fusion smoothing module to receive the plurality of wind detection flags and generate an output wind detection flag. Microphones generate the plurality of audio input signals. The wind detector and the fusion smoothing module may comprise program instructions stored in the memory for execution by a digital signal processor. The wind detector is a single channel detector to receive a single audio channel of the audio input signal and generate the single channel wind noise flag, and a cross-channel detector to compute auto correlations and a cross correlation between two or more audio channels.

20 Claims, 6 Drawing Sheets

(56) References Cited

U.S. PATENT DOCUMENTS

| | | | | |
|---|---|---|---|---|
| 2015/0058002 | A1* | 2/2015 | Yermeche | G10L 25/84 704/233 |
| 2016/0080864 | A1* | 3/2016 | Scarlett | H04R 3/005 381/94.1 |
| 2017/0374477 | A1* | 12/2017 | Salvatucci | H04R 25/407 |
| 2018/0176704 | A1* | 6/2018 | Sapozhnykov | H04R 3/005 |
| 2018/0277138 | A1* | 9/2018 | Kudryavtsev | G10L 21/0232 |
| 2019/0069074 | A1* | 2/2019 | Yamkovoy | H04R 1/1083 |
| 2019/0244627 | A1* | 8/2019 | Sapozhnykov | H04R 3/00 |

* cited by examiner

WIND NOISE DETECTION SYSTEMS AND METHODS

TECHNICAL FIELD

The present application relates generally to noise cancelling systems and methods, and more specifically, for example, to the cancellation and/or suppression of wind noise in audio processing devices such as headphones (e.g., circum-aural, supra-aural and in-ear types), earbuds, and hearing aids, and other personal listening devices.

BACKGROUND

Audio processing devices generally include one or more microphones to sense sounds from the environment and produce corresponding audio signals. An active noise cancellation (ANC) headphone, for example, includes a reference microphone to generate an anti-noise signal that is approximately equal in magnitude, but opposite in phase, to the sensed ambient noise. The ambient noise and the anti-noise signal cancel each other acoustically, allowing the user to hear a desired audio signal.

Conventional ANC systems (and other noise reduction or cancellation systems) do not, however, completely cancel all noise, leaving residual noise and/or generating audible artefacts that may be distracting to the user. For example, unlike ambient sounds cancelled in an ANC system, wind noise may occur at the microphone in response to local air turbulence at the microphone components. Wind noise may not be correlated to the ambient noise that reaches the user's ear canal, and the corresponding anti-noise signal may be audible to the user. Noise suppression systems that attempt to remove background noise from an audio signal face similar challenges in removing wind noise.

In view of the foregoing, there is a continued need for improved noise reduction and noise cancellation systems and methods for audio signals that may include sensed wind noise. There is also a continued need for improved active noise cancellation systems and methods for headphones, earbuds and other personal listening devices that may operate in windy environments.

SUMMARY

Improved systems and methods are disclosed herein for active noise cancellation and/or noise suppression in audio devices that may be used in windy environments. In one or more embodiments, a system comprises a wind detector operable to receive a plurality of audio input signals and output a plurality of wind detection flags including a single channel wind detection flag and a cross-channel wind detection flag, each wind detection flag indicating a presence or absence of wind noise, and a fusion smoothing module operable to receive the plurality of wind detection flags and generate an output wind detection flag, the output wind detection flag.

The system may further include a plurality of microphones operable to sense sound and generate the plurality of audio input signals, and a memory storing program instructions, and a digital signal processor operable to execute the program instructions. In various implementations, the system may include a noise suppression module operable to receive the audio input signals and the output wind detection flag and reduce wind noise detected in the audio input signals, and/or an active noise cancellation system operable to generate an anti-noise signal to cancel a portion of the audio input signals in accordance with the output wind detection flag.

In various embodiments, the wind detector includes a single channel detector operable to receive a single audio channel of the plurality of audio input signals and generate the single channel wind detection flag. The single channel detector may be operable to compare the single audio channel with a wind spectrum model that comprises a mean and a standard deviation of a power ratio of a portion of frequency components and a spectrum slope. The wind detector is operable to clear a flag if the mean of the power ratio is less than a threshold mean and the standard deviation is greater than a threshold standard deviation (e.g., when wind noise is determined to be absent) and set a flag if the spectrum slope is greater than a predetermined threshold spectrum slope (e.g., when wind noise is determined to be present). The wind detector may further include a cross-channel detector operable to compute auto correlations and a cross correlation between two or more audio channels and set a flag if the auto correlations are less than the cross correlation.

The fusion smoothing module may be operable to set the output wind detection flag to "present" if the cross-channel wind detection flag is on and at least one single channel wind detection flag is on and set a fusion wind flag if a predetermined number of previously generated fusion wind flags are on.

In one or more embodiments, a method includes receiving a plurality of audio input signals, generating a plurality of preliminary wind detection flags including a single channel wind detection flag and a cross-channel wind detection flag, each wind detection flag indicating a presence or absence of wind noise in a portion of the audio input signals, and outputting the wind detection flag. The method may further include reducing wind noise in the audio input signals if the wind detection flag is active, and/or generating anti-noise signal to cancel a portion of the audio input signals in accordance with the wind detection flag.

In various embodiments, the method includes receiving a single audio channel of the audio input signal and generating the single channel wind detection flag, generating a wind spectrum model by calculating a mean and a standard deviation of a power ratio of certain frequency components and a spectrum slope, and comparing the single audio channel with a wind spectrum model. If the mean of the power ratio is less than a threshold mean and the standard deviation is greater than a threshold standard deviation, the method may set the single channel wind detection flag to indicate that wind noise is absent. If the spectrum slope is greater than a predetermined threshold spectrum slope, then the method may set the single channel wind noise flag to indicate that wind noise is present.

The method may further include computing auto correlations and a cross correlation between two or more audio channels and determining that wind noise is present if the auto correlations are less than the cross correlations. The final wind detection flag may be set to "present" if the cross-channel detector wind noise flag is on and at least one of the single channel audio flags is on. The method may further smooth the fusion wind detection flag based on a number of previously determine fusion wind detection flag values.

The scope of the invention is defined by the claims, which are incorporated into this section by reference. A more complete understanding of embodiments of the disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Improved wind noise detection systems and methods are disclosed that may be implemented in a variety of audio processing systems including active noise cancellation (ANC) systems, mobile phones, smart speakers, voice command and processing systems, automotive systems (e.g., handsfree voice controls) and other audio processing systems that may operate in a windy environment.

In one embodiment, a wind noise detection system includes two or more spatially separated microphones. Each microphone senses sound in the environment, which may include wind noise sensed due to air turbulence local to each microphone. As a result, the different microphones may independently sense different wind noise events. A wind noise detection system analyzes single channel wind features associated with each microphone and cross-channel wind features for two or more of the audio channels. In one embodiment, the single channel wind features characterize the spectrum of the wind noise, and the cross-channel wind features evaluate the cross correlation between pairs of microphone signals. A fusion-smoothing stage operates to fuse the resulting features, filter the detection results, and improve system stability.

The system and methods disclosed herein provide numerous advantages over conventional solutions. For example, the wind detection systems and methods of the present disclosure explore both single and cross-channel wind features and employ a fusion-smoothing stage to filter the detection results. The single channel feature detector may include a unique decision tree structure as disclosed herein, and the features may include the mean and standard deviation of a low frequency component power ratio and the spectrum slope between 500 Hz and 1000 Hz, for example. The calculated ratio mean and standard deviation provide good indicators for separating wind noise from speech for use in various voice applications. Further, the spectrum slope allows for the discrimination of wind noise and ambient background noise (such as office and street noise). The cross-channel feature provides a cross correlation of the two channel signals. Unlike approaches that work in time domain, the proposed wind detection system may compute the cross correlation in frequency domain. In various embodiments, the phase information may be discarded, and/or the cross correlation may be performed on the whole frequency band or using low frequency components only, for example.

Figure 1:
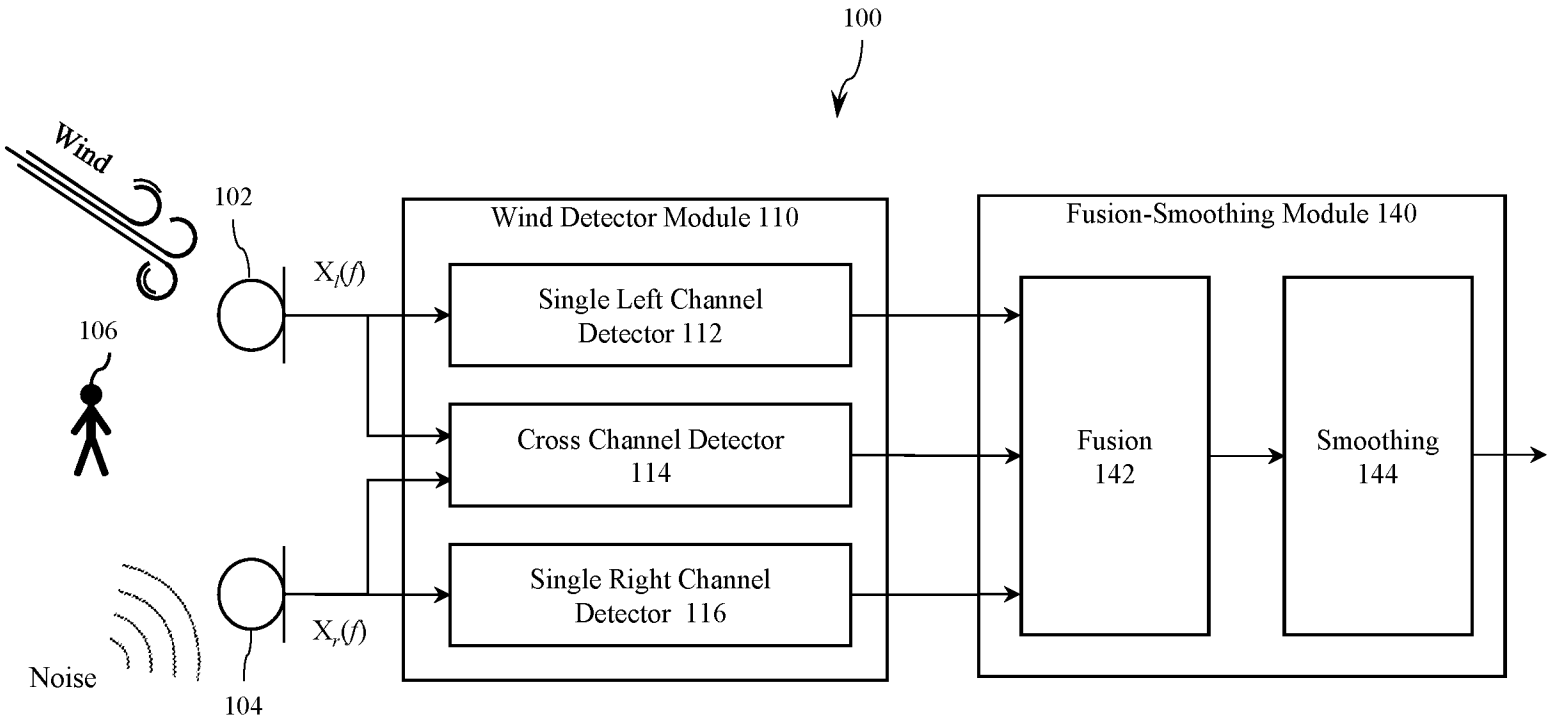
FIG. 1 illustrates a wind detection system, in accordance with one or more embodiments of the present disclosure.

Referring to FIG. 1, a wind detection system 100 will now be described, in accordance with one or more embodiments. The wind detection system 100 may be implemented an audio processing system with two or more microphones to monitor the presence of wind in the environment. In some embodiments, the wind detection system 100 is implemented in the audio input processing components of an audio device that may include a digital signal processor (DSP) configured to suppress noise, detect speech, separate a target signal and/or perform other multichannel audio input processing. The wind detection system 100 may generate wind noise information that may be used to optimize the audio device's noise suppression performance. For example, a two-channel wind detection system can be used on a headphone equipped with two external microphones (e.g., on the left and right sides) to monitor environmental sound.

The wind detection system 100 includes a plurality of microphones or other audio sensors, such as a left microphone 102 and a right microphone 104, a wind detector module 110 and a fusion-smoothing module 140. Each microphone (102 and 104) senses sound in the external environment, which may include sound from a desired target source 106, sounds from noise sources and sound generated locally by wind. Each of the microphones generates an input audio signal, which is digitally sampled and transformed to the frequency domain as a left channel, $X_l(f)$, and a right channel, $X_r(f)$, where f is the frequency.

The wind detector module 110 receives $X_l(f)$ and $X_r(f)$ as inputs. The wind detector module 110 includes a plurality of detector submodules configured to analyze features of the input signals. In the illustrated embodiment, the wind detector module 110 includes a single left channel detector 112, a single right channel detector 116, and a cross-channel detector 114. The wind detector system 100 may include additional microphones and the wind detector module 110 may include additional single channel detectors corresponding to each microphone and additional cross channel detectors corresponding to groupings of two of more of the microphones.

The single left channel detector 112 compares $X_l(f)$ with a wind spectrum model. The features to be considered in the comparison may include: (1) the mean and standard deviation of the power ratio of low frequency components $\overline{\varphi}_l$ and $\sigma_l$; and (2) the spectrum slope $\beta_l$. The calculation of the mean and standard deviation of the power ratio of low frequency components $\overline{\varphi}_l$ and $\sigma_l$ will now be described. It is observed that the wind noise is typically concentrated at the low frequency bands (e.g. <1000 Hz), while human speech (e.g., desired target audio in a voice-controlled device) has more high frequency powers and its power distribution is time dependent. Thus, the power ratio of low frequency components in wind noise is less time dependent and more stable than voice signals. In one embodiment, the power ratio is computed by $$\varphi_l=\Sigma_{f<f_{th}}|X_l(f)|^2/\Sigma|X_l(f)|^2,$$

where $f_{th}$ is the low frequency threshold. The single left channel detector 112 compares the mean and standard deviation of $\varphi_l$, $\overline{\varphi}_l$ and $\sigma_l$, to their thresholds $\varphi_{th}$ and $\sigma_{th}$. If $\overline{\varphi}_l<\varphi_{th}$ or $\sigma_l>\sigma_{th}$, it indicates that wind noise is absent, and voice dominates the signal.

Figure 2:
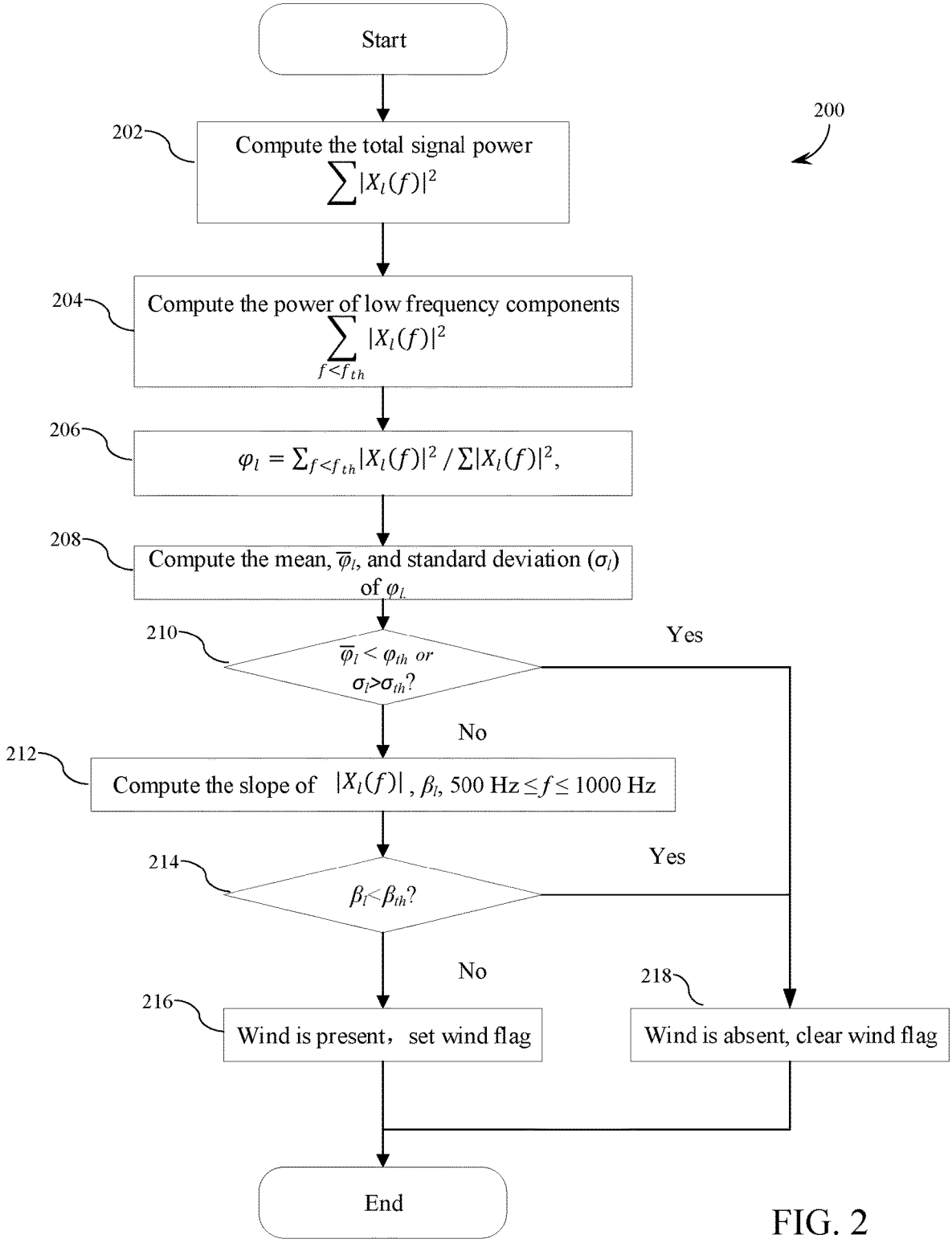
FIG. 2 illustrates a flow chart of a single channel wind detector, in accordance with one or more embodiments of the present disclosure.

The calculation of the spectrum slope $\beta_l$ will now be described with reference to FIG. 2. It is observed that the wind noise typically has a linear spectrum slope $\beta_l$ between 500 Hz and 1000 Hz. The single left channel detector 112 compares $\beta_l$ to the expected slope threshold $\beta_{th}$. If $\beta_l<\beta_{th}$, it indicates the wind is absent and background noise dominates the signal. FIG. 2 illustrates an embodiment of a process 200 for operating the single left channel detector 112. The process 200 may be implemented in various combinations of hardware and software including, for example, as program instructions stored in a memory for execution by a digital processor.

In step 202, the single left channel detector computes the total signal power $\Sigma|X_l(f)|^2$. In step 204, the single left channel detector computes the power of low frequency components as $\Sigma_{f<f_{th}}|X_l(f)|^2$. Next, in step 206, the power ratio $\varphi_l=\Sigma_{f<f_{th}}|X_l(f)|^2/\Sigma|X_l(f)|^2$ is computed, and in step 208, the mean and standard deviation of $\varphi_l$, $\overline{\varphi}_l$ and $\sigma_l$, are updated. In step 210, if $\overline{\varphi}_l<\varphi_{th}$ or $\sigma_l>\sigma_{th}$, the current signal is voice and wind is absent. The detector then clears the wind flag and provides the wind flag as an output in step 218. If $\overline{\varphi}_l<\varphi_{th}$ or $\sigma_l>\sigma_{th}$, is false, then the single left channel detector computes the spectrum slope $\beta_l$ between 500 Hz and 1000 Hz in step 212. In step 214, if $\beta_l<\beta_{th}$, the current signal is background noise and wind is absent. The detector clears and outputs the wind flag in step 218. If $\beta_l<\beta_{th}$ is false, then the current signal is neither voice nor background noise. A determination is made that wind is present and the wind flag is set and output in step 216.

The process 200 may also be used to detect the presence or absence of noise through the single right channel detector 116. The single right channel detector 116 may store program instructions for causing a processor to execute the process 200, which is applied to $X_r$ (f) to set a wind flag for the right input audio channel.

In various embodiments, a two-level decision checking process is used to discriminate wind noise from voice and background noise. The process includes a cross-channel detector 114 that processes both $X_l(f)$ and $X_r(f)$. In some embodiments, the cross-channel detector 114 is implemented as program instructions stored in memory for instructing a digital signal processor to execute the processes disclosed herein. In one embodiment, the cross-channel detector 114 is configured to compute the auto-correlations and cross-correlation of the left and right channels as follows:

$$\gamma_l^2=\Sigma|X_l(f)|^2$$

$$\gamma_r^2=\Sigma|X_r(f)|^2$$

$$\gamma_{l,r}=\Sigma|X_l(f)||X_r(f)|$$

Note that the correlation parameters $\gamma_l^2$, $\gamma_r^2$, and $\gamma_l^r$ are computed in the above example without phase information. The wind noise may be created by local air turbulence at each microphone, which results in differences between the wind signals observed at the left microphone and the right microphone. The cross-channel detector compares $\gamma_{l,r}^2$ to $\alpha\gamma_l^2\gamma_r^2$, where $\alpha$ is a threshold coefficient. If $\gamma_{l,r}^2<\alpha\gamma_l^2\gamma_r^2$, then it is determined that wind is present, and the wind flag is set.

Figure 3:
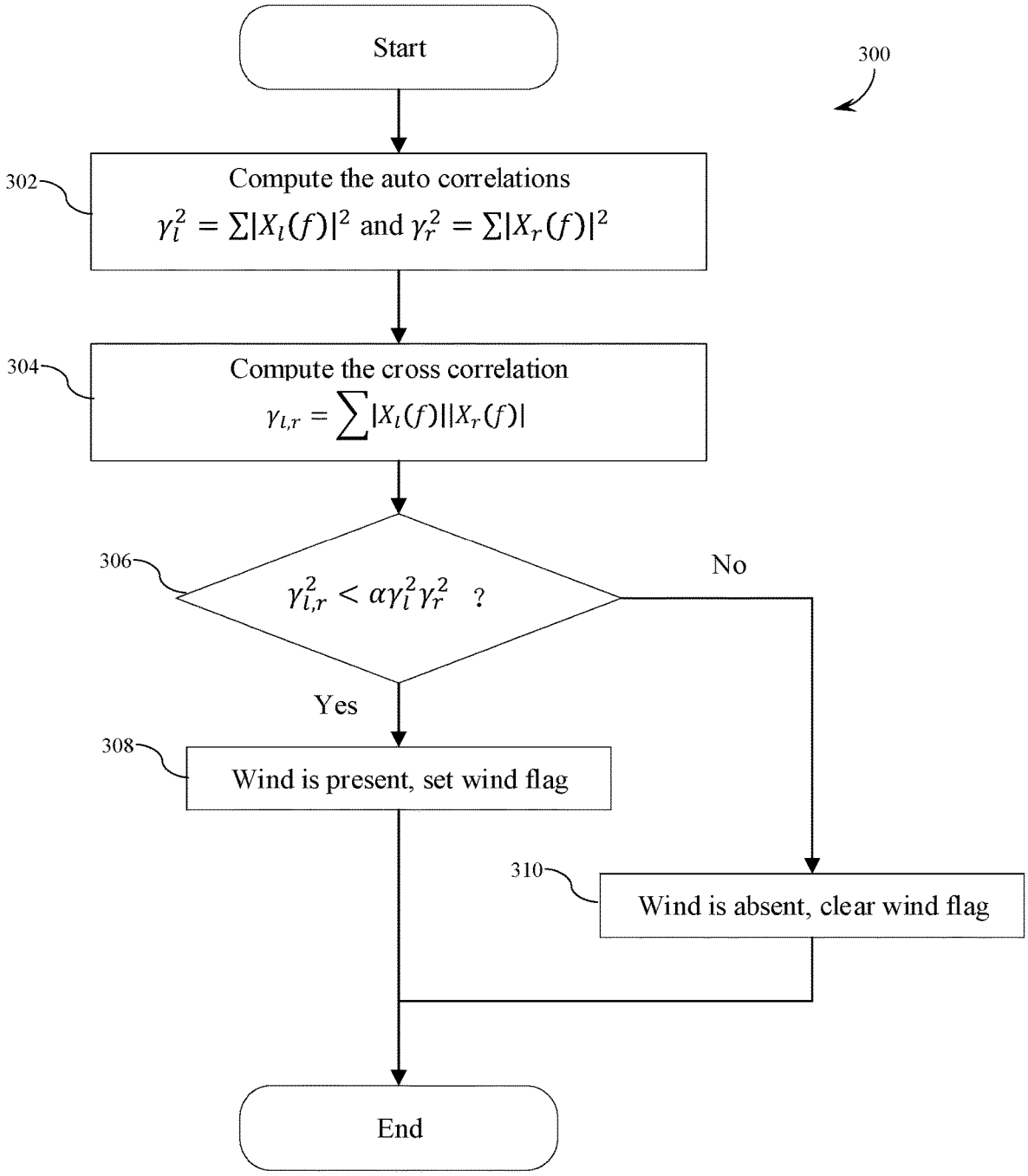
FIG. 3 illustrates a flow chart of a cross-channel wind detector, in accordance with one or more embodiments of the present disclosure.

FIG. 3 illustrates an embodiment of a process 300 for operating the cross-channel detector 114. In step 302, the cross-channel detector computes the auto correlations $\gamma_l^2=\Sigma|X_l(f)|^2$ and $\gamma_r^2=\Sigma|X_r(f)|^2$. In step 304, the cross correlation $\gamma_{l,r}=\Sigma|X_l(f)||X_r(f)|$ is computed. In step 306, if $\gamma_{l,r}^2<\alpha\gamma_l^2\gamma_r^2$, then wind is determined to be present and the cross-channel detector 114 sets the wind flag in step 308. Otherwise, the cross-channel detector 114 clears the wind flag in step 310.

Referring back to FIG. 1, the wind detector module 110 outputs the results of the single left channel detector 112, the single right channel detector 116, and the cross-channel detector 114 to the fusion-smoothing module 140. The results of each of the three detectors are fused by the rule that determines wind detection. For example, the output of each of the three detectors may be fused by the rule that the wind is determined to be present when the wind flags of the cross-channel detector 114 and at least one of the single channel detectors 112 and 116, are set.

Figure 4:
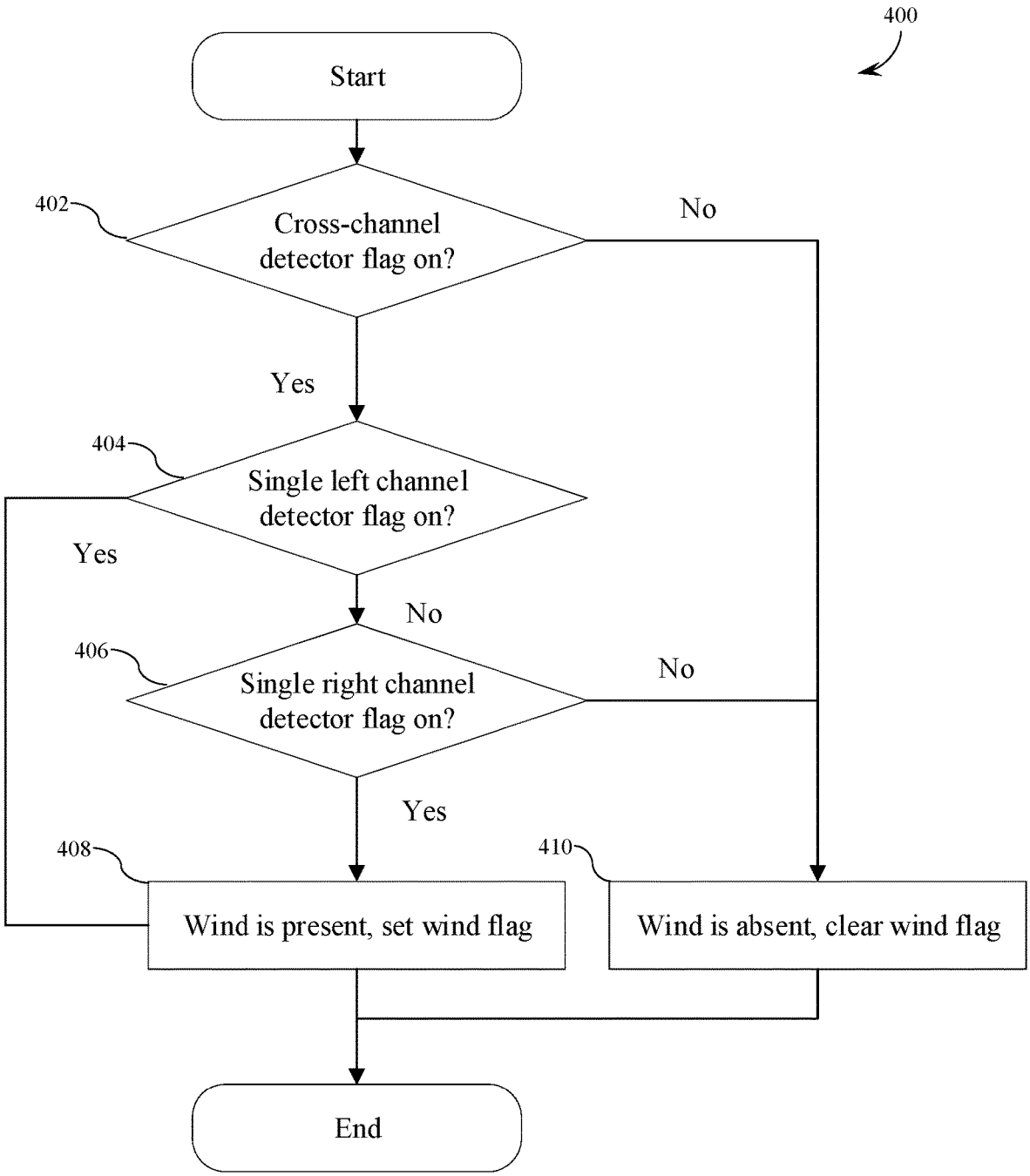
FIG. 4 illustrates a flow chart of a fusion stage in the fusion-smoothing module, in accordance with one or more embodiments of the present disclosure.

Referring to FIG. 4, an embodiment of the operation of the fusion module 142 will now be described. The process 400 may be implemented in various hardware and/or software configuration including, for example, as program instructions stored in a memory of an audio processor for execution by a digital signal processor. In step 402, if the wind flag of the cross-channel detector 114 is off, then wind is absent then the fusion wind flag is cleared in step 410. In step 404, if the cross-channel detector 114 wind flag is on and the single left channel detector 112 flag is on, then wind is determined to be present and the fusion wind flag is set in step 408. In step 406, if the single left channel detector flag is not on and the wind flag of the single right channel detector 116 is on, then wind is determined to be present, and the fusion wind flag is set in step 408. Otherwise, wind is absent, and the fusion wind flag is cleared in step 410.

The fusion wind flags are further smoothed to address missing detection and false alarm events. For example, in one embodiment the smoothing method checks the last N fusion wind flags to determine whether to change a wind detection status. If all of the last N wind flags are on, then the smoothed wind flag is on. If all of the last N wind flags are off, then the smoothed wind flag is off. Otherwise, the smoothed wind flag may be maintained in its current state. Other settings and algorithms may also be used to increase or decrease sensitivity to wind detection events, depending on the goals of the system.

Figure 5:
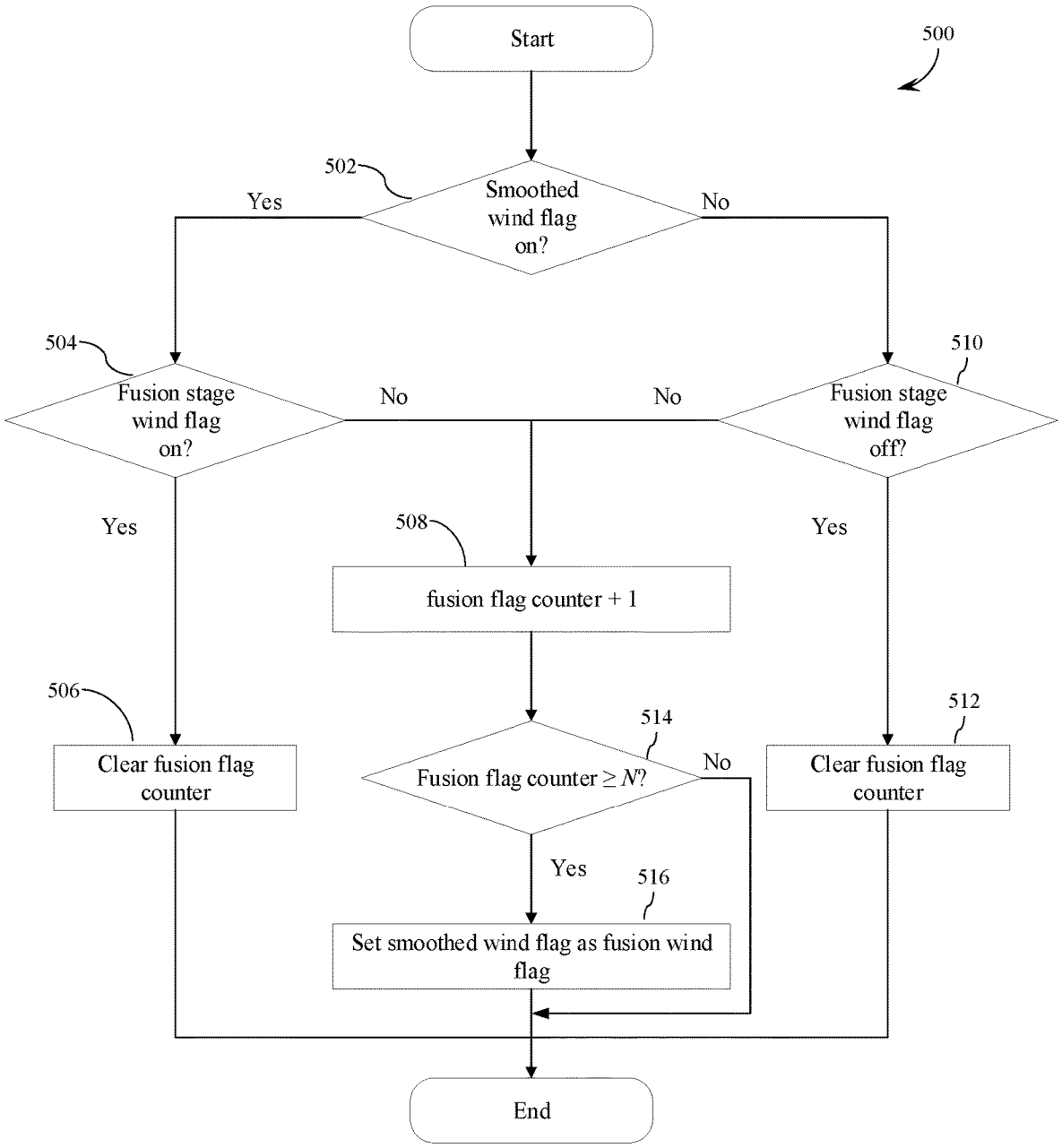
FIG. 5 illustrates a flow chart of the smoothing stage in a fusion-smoothing module.

Referring to FIG. 5 an embodiment of smoothing operations performed by the smoothing module 144 of FIG. 1 will now be described. The smoothing operations 500 may be implemented in various hardware and software configurations including, for example, as program instructions stored in a memory for execution by a digital signal processor. In step 502, if the smoothed wind flag is "on" and the fusion stage wind flag is "on" (step 504), then the fusion flag counter is reset in step 506. If the fusion stage wind flag is "off" then the fusion flag counter is incremented by one in step 508. Referring back to step 502, if the smoothed wind flag is "off" and the fusion stage wind flag is "off" (step 510), then fusion flag counter is reset in step 512. If the fusion stage wind flag is "on" (step 510), then the fusion flag counter is incremented by one in step 508. In step 514, if the fusion flag counter is greater than or equal to N (e.g., where N equals a number of successive wind flags), the smoothed wind flag is set to be equal to the fusion wind flag (step 516).

In various embodiment, wind detection can be implemented in various devices with two or more microphones, such as cell phone, PDA, smart speakers, smart watches, headphones, and hearing aids. There are many frequency domain transformation algorithms for the microphone signals, such as Fourier transform, and Wavelet transform. The present disclosure is not limited to one specific algorithm. The proposed wind detector can be extended to multiple microphone case. The wind detector module can output the feature values of $\varphi$, $\sigma$, $\beta$, and $\gamma$ instead of the detector wind flags. The wind detector module can smooth the features $\varphi$, $\sigma$, $\beta$, and $\gamma$ to obtain long term feature estimates before threshold comparison. The features can be smoothed by FIR filters and IIR filters. The fusion-smoothing module can employ other common machine learning algorithms to fuse the wind detector module results, such as logistic regression, naïve Bayesian, and neural networks. The fusion-smoothing module can employ other common filtering algorithms to perform result smoothing, such as median filter, FIR filtering, and IIR filtering.

Figure 6:
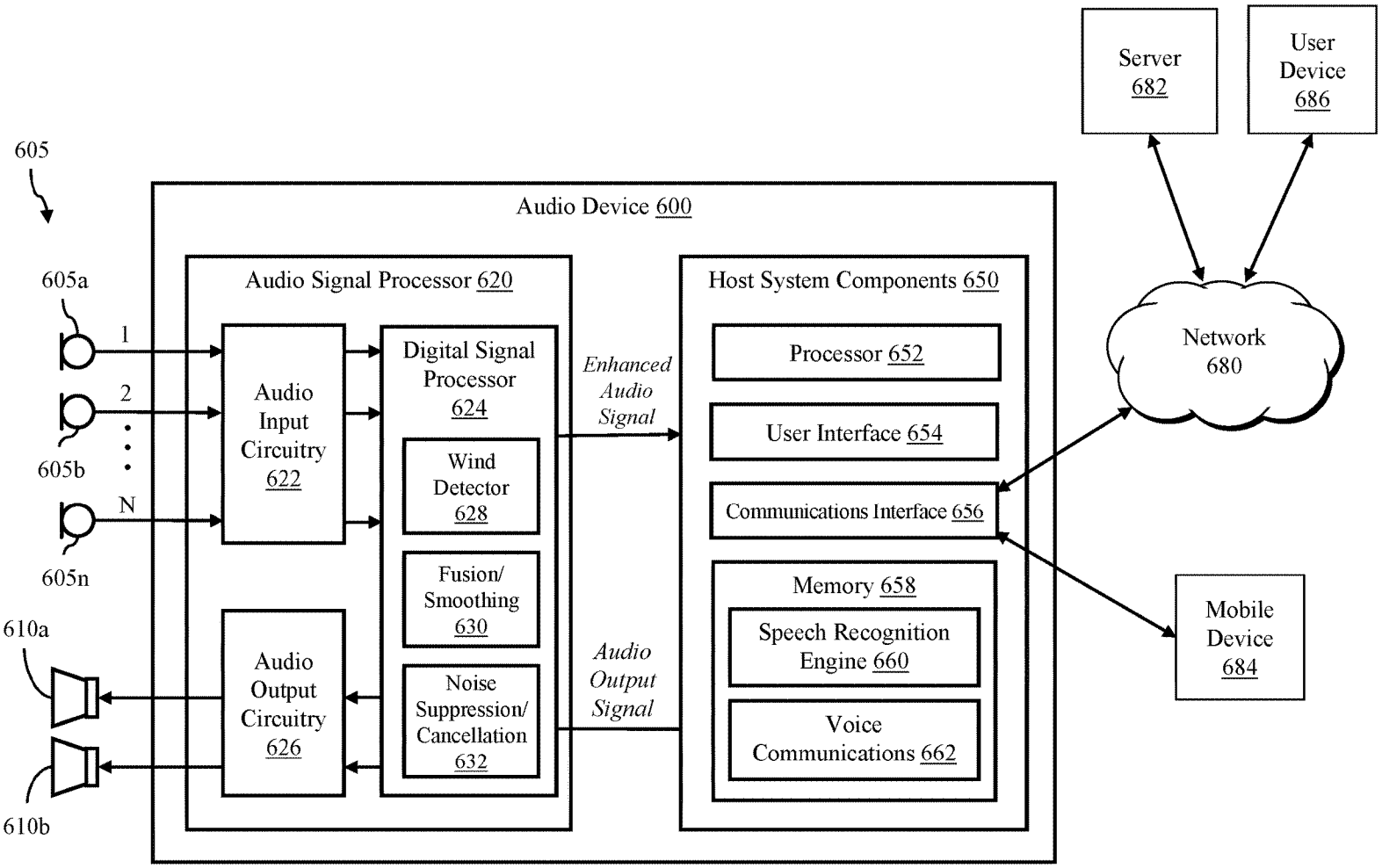
FIG. 6 illustrates an embodiment of an audio device, in accordance with one or more embodiments of the present disclosure.

Referring to FIG. 6, an example system incorporating wind detection processing of the present disclosure will now be described. An audio device 600 includes an audio input, such as an audio sensor array 605, an audio signal processor 620 and host system components 650. The audio sensor array 605 comprises one or more sensors, each of which may convert sound waves into an audio signal. In the illustrated environment, the audio sensor array 605 includes a plurality of microphones 605*a*-605*n*, each generating one audio channel of a multi-channel audio signal.

The audio signal processor 620 includes audio input circuitry 622, a digital signal processor 624 and optional audio output circuitry 626. In various embodiments the audio signal processor 620 may be implemented as an integrated circuit comprising analog circuitry, digital circuitry and the digital signal processor 624, which is operable to execute program instructions stored in memory. The audio input circuitry 622, for example, may include an interface to the audio sensor array 605, anti-aliasing filters, analog-to-digital converter circuitry, echo cancellation circuitry, and other audio processing circuitry and components.

The digital signal processor 624 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to perform various operations discussed herein for embodiments of the disclosure.

The digital signal processor 624 is operable to process the multichannel digital audio input signal to generate an enhanced audio signal, which is output to one or more host system components 650. The digital signal processor 624 is operable to interface and communicate with the host system components 650, such as through a bus or other electronic communications interface. In various embodiments, the multichannel audio signal includes a mixture of noise signals and at least one desired target audio signal (e.g., human speech), and the digital signal processor 624 is operable to isolate or enhance the desired target signal, while reducing or cancelling the undesired noise signals. The digital signal processor 624 may be operable to perform wind noise detection, speech/keyword detection and processing, echo cancellation, noise cancellation, target signal tracking and enhancement, post-filtering, and other audio signal processing.

In the illustrated embodiment, the digital signal processor 624 includes a wind detector 628 (e.g., wind detector module 110 of FIG. 1) and a fusion-smoothing component 630 (e.g., fusion-smoothing module 140 of FIG. 1) operable to determine whether wind noise is present in a current audio sample. The audio signal processor 620 may be configured to produce an enhanced target signal for further processing by the host system components (e.g., voice input for voice communications, voice command processing, etc.). The digital signal processor 624 may use the indication of the presence or absence of wind noise in a noise suppression process to aid in the removal of the detected wind noise. In another embodiment, the audio signal processor 620 may be configured for active noise cancellation, and the indication of the presence or absence of wind noise may be used by the digital signal processor 624 to aid in the generation of an anti-noise signal. The digital signal processor 624 may further include other modules that utilize the final wind detection flag, such as a noise suppression/cancellation module 632. In various embodiments, the noise suppression/cancellation module 632 may provide noise suppression of wind noise in the input audio signals and/or generate an anti-noise for active noise cancellation in windy conditions.

The audio output circuitry 626 processes audio signals received from the digital signal processor 624 for output to at least one speaker, such as speakers 610*a* and 610*b*. The audio output circuitry 626 may include a digital-to-analog converter that converts one or more digital audio signals to corresponding analog signals and one or more amplifiers for driving the speakers 610*a* and 610*b*.

The audio device 600 may be implemented as any device operable to receive and detect target audio data, such as, for example, a mobile phone, smart speaker, tablet, laptop computer, desktop computer, voice-controlled appliance, or automobile. The host system components 650 may comprise various hardware and software components for operating the audio device 600. In the illustrated embodiment, the host system components 650 include a processor 652, user interface components 654, a communications interface 656 for communicating with external devices and networks, such as network 680 (e.g., the Internet, the cloud, a local area network, or a cellular network) and mobile device 684, and a memory 658.

The processor 652 may comprise one or more of a processor, a microprocessor, a single-core processor, a multi-core processor, a microcontroller, a programmable logic device (PLD) (e.g., field programmable gate array (FPGA)), a digital signal processing (DSP) device, or other logic device that may be configured, by hardwiring, executing software instructions, or a combination of both, to perform various operations discussed herein for embodiments of the disclosure. The host system components 650 are operable to interface and communicate with the audio signal processor 620 and the other host system components 650, such as through a bus or other electronic communications interface.

It will be appreciated that although the audio signal processor 620 and the host system components 650 are shown as incorporating a combination of hardware components, circuitry and software, in some embodiments, at least some or all of the functionalities that the hardware components and circuitries are operable to perform may be implemented as software modules being executed by the processor 652 and/or digital signal processor 624 in response to software instructions and/or configuration data, stored in the memory 658 or firmware of the digital signal processor 624.

The memory 658 may be implemented as one or more memory devices operable to store data and information, including audio data and program instructions. Memory 658 may comprise one or more various types of memory devices including volatile and non-volatile memory devices, such as RAM (Random Access Memory), ROM (Read-Only Memory), EEPROM (Electrically-Erasable Read-Only Memory), flash memory, hard disk drive, and/or other types of memory.

The processor 652 may be operable to execute software instructions stored in the memory 658. In various embodiments, a speech recognition engine 660 is operable to process the enhanced audio signal received from the audio signal processor 620, including identifying and executing voice commands. Voice communications components 662 may be operable to facilitate voice communications with one or more external devices such as a mobile device 684 or user device 686, such as through a voice call over a mobile or cellular telephone network or a VoIP call over an IP (internet protocol) network. In various embodiments, voice communications include transmission of the enhanced audio signal to an external communications device.

The user interface components 654 may include a display, a touchpad display, a keypad, one or more buttons and/or other input/output components operable to enable a user to directly interact with the audio device 600. The communications interface 656 facilitates communication between the audio device 600 and external devices. For example, the communications interface 656 may enable Wi-Fi (e.g., 802.11) or Bluetooth connections between the audio device 600 and one or more local devices, such as mobile device 684, or a wireless router providing network access to a remote server 682, such as through the network 680. In various embodiments, the communications interface 656 may include other wired and wireless communications components facilitating direct or indirect communications between the audio device 600 and one or more other devices.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A system comprising:

a wind detector configured to receive a plurality of audio input signals and output a plurality of wind detection flags including a single channel wind detection flag and a cross-channel wind detection flag, each wind detection flag indicating a presence or absence of wind noise; and a fusion smoothing module configured to receive the plurality of wind detection flags and generate an output wind detection flag.

2. The system of claim 1, further comprising a plurality of microphones configured to sense sound and generate the plurality of audio input signals.

3. The system of claim 1, further comprising a memory storing program instructions, and a digital signal processor configured to execute the program instructions; and wherein the wind detector and the fusion smoothing module comprise program instructions stored in the memory.

4. The system of claim 1, further comprising a noise suppression module configured to receive the audio input signals and the output wind detection flag and reduce wind noise detected in the audio input signals.

5. The system of claim 1, further comprising an active noise cancellation system configured to generate an anti-noise signal to cancel a portion of the audio input signals in accordance with the output wind detection flag.

6. The system of claim 1, wherein the wind detector comprises a single channel detector configured to receive a single audio channel of the plurality of audio input signals and generate the single channel wind detection flag.

7. The system of claim 6, wherein the single channel detector is configured to compare the single audio channel with a wind spectrum model.

8. The system of claim 7, wherein the wind spectrum model comprises a mean and a standard deviation of a power ratio of a portion of frequency components and a spectrum slope and wherein if the mean of the power ratio is less than a threshold mean or the standard deviation of the power ratio is greater than a threshold standard deviations, then wind noise is determined to be absent; and wherein if the spectrum slope is greater than a predetermined threshold spectrum slope, then wind is determined to be present.

9. The system of claim 6, wherein the wind detector comprises a cross-channel detector configured to compute auto correlations and a cross correlation between two or more audio channels, and wherein wind is determined to be present if the auto correlations are less than the cross correlation.

10. The system of claim 1, wherein the fusion smoothing module is configured to set the output wind detection flag to present if the cross-channel wind detection flag is on and at least one single channel wind detection flag is on.

11. The system of claim 1, wherein the fusion smoothing function is configured to set a fusion wind flag if a predetermined number of previously generated fusion wind flags are on.

12. A method comprising:

receiving a plurality of audio input signals;

generating a plurality of preliminary wind detection flags including a single channel wind detection flag and a cross-channel wind detection flag, each wind detection flag indicating a presence or absence of wind noise in a portion of the audio input signals; and outputting the wind detection flag based on the plurality of preliminary detection flags.

13. The method of claim 12, further comprising reducing wind noise in the audio input signals if the wind detection flag is active.

14. The method of claim 12, further comprising generating anti-noise signal to cancel a portion of the audio input signals in accordance with the wind detection flag.

15. The method of claim 12, further comprising receiving a single audio channel of the audio input signal and generating the single channel wind detection flag.

16. The method of claim 15, further comprising comparing the single audio channel with a wind spectrum model.

17. The method of claim 16, further comprising generating the wind spectrum model by calculating a mean and a standard deviation of a power ratio of certain frequency components and a spectrum slope;

if the mean of the power ratio is less than a threshold mean or the standard deviation is greater than a threshold standard deviation, setting the single channel wind detection flag to indicate that wind noise is absent; and if the spectrum slope is greater than a predetermined threshold spectrum slope, then setting the single channel wind noise flag to indicate that wind noise is present.

18. The method of claim 16, further comprising computing auto correlations and a cross correlation between two or more audio channels; and determining that wind noise is present if the auto correlations are less than the cross correlations.

19. The method of claim 12, further comprising setting a final wind detection flag to present if the cross-channel detector wind noise flag is on and at least one of the single channel audio flags is on.

20. The method of claim 19, further comprising smoothing the fusion wind detection flag based on a number of previously determine fusion wind detection flag values.

* * * * *